US006577082B2

(12) United States Patent
Yang et al.

(10) Patent No.: US 6,577,082 B2
(45) Date of Patent: Jun. 10, 2003

(54) DEFLECTION YOKE FOR BRAUN TUBE

(75) Inventors: Woo Young Yang, Gumi (KR); Jong Ho Lim, Daegu (KR); Gyoo Hwan Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/858,963

(22) Filed: May 17, 2001

(65) Prior Publication Data

US 2002/0060535 A1 May 23, 2002

(30) Foreign Application Priority Data

Aug. 31, 2000 (KR) ..... 2000-51058
Oct. 10, 2000 (KR) ..... 2000-59501
Oct. 31, 2000 (KR) ..... 2000-64286

(51) Int. Cl.[7] ..... G09G 1/28

(52) U.S. Cl. ..... 315/368.25; 313/421; 313/426; 313/440

(58) Field of Search ..... 315/368.26, 368.25, 315/364; 313/413, 421, 426, 440, 399, 461

(56) References Cited

U.S. PATENT DOCUMENTS 4,151,561 A * 4/1979 Kratz et al. ..... 335/210
4,429,254 A * 1/1984 Chang ..... 313/402
5,059,858 A * 10/1991 Shimoma et al. ..... 313/440

* cited by examiner

*Primary Examiner*—Don Wong
*Assistant Examiner*—Thuy Vinh Tran
(74) *Attorney, Agent, or Firm*—Fleshner & Kim, LLP

(57) ABSTRACT

In a deflection yoke for a braun tube deflecting an electron beam radiated from an electron gun to a screen and including a horizontal deflection coil, a vertical deflection coil and a ferrite core, the horizontal deflection coil is installed inside a funnel, the ferrite core is installed outside of the funnel, the vertical deflection coil is installed inside or outside of the funnel, accordingly the convergence and deflection sensitivity of an electron beam can be easily compensated, the deflection sensitivity of a braun tube can improve, and the degree of freedom in designing the deflection yoke and an electron gun related to enlarging a diameter of the electron gun can increase.

13 Claims, 3 Drawing Sheets

DEFLECTION YOKE FOR BRAUN TUBE

BACKGROUND OF THE INVENTION

1. Field of the Invention

The present invention relates to a braun tube reproducing a received electric signal as a video signal, and in particular to a deflection yoke for a braun tube which is capable of deflecting an electron beam radiated from an electron gun toward a screen.

2. Description of the Prior Art

A braun tube is for displaying a picture by converting an electric signal into an optical image such as a graphic, a character, etc. by an operation of an electron beam and is used for a video display unit such as a television, a monitor, etc.

As depicted in FIG. 1, a braun tube includes a funnel 10 as a vacuum bulb, a panel 12 maintaining a vacuum state by combining with the funnel 10 and reproducing colors by a R.G.B (Red, Green, Blue) fluorescent substance coated at its inner surface, an electron gun 14 installed at the rear of the funnel 10 and radiating R.G.B electron beams toward the panel 12, a shadow mask 16 installed with a certain distance from the panel 12 and performing a color selection function, and a deflection yoke 20 installed at a neck portion 11 of the funnel 10 and deflecting an electron beam radiated from the electron gun 14.

Herein, the deflection yoke 20 deflects an electron beam radiated from the electron gun 14 by using the principle of a magnetic field generated by a coil in order to make the electron beam sequentially contact to a pertinent pixel on a request position of a screen 12*a*.

The deflection yoke 20 includes a horizontal deflection yoke 21 deflecting an electron beam in a horizontal direction on the basis of a center of deflection by generating a magnetic field in a vertical direction, a vertical deflection coil 23 deflecting an electron beam in a vertical direction on the basis of the center of deflection by generating a magnetic field in a horizontal direction, and a ferrite core 25 preventing a magnetic field generated by currents applied to the horizontal and vertical deflection coils 21, 23 from leaking out and strengthening a magnetic force at the same time.

And, the deflection yoke 20 includes a holder 27 determining correlation positions of the horizontal deflection coil 21 and vertical deflection coil 23, and guaranteeing insulation between them.

In the braun tube in accordance with the prior art, when an electron beam is radiated from the electron gun 14, the electron beam reaches to the screen 12*a* through the deflection yoke 20, herein the electron beam moves in a horizontal direction under the influence of a magnetic field of the horizontal deflection coil 21 and in a vertical direction under the influence of a magnetic field of the vertical deflection coil 23.

Accordingly, the electron beam radiated from the electron gun 14 can reach to the whole parts of the screen 12*a* by motions in both the horizontal and vertical directions under the influence of the horizontal and vertical deflection coils 21, 23.

And, the ferrite core 25 is for forming the deflection force sufficiently by preventing the magnetic field generated by the vertical and horizontal deflection coils 21, 23 from leaking out to a surrounding space and strengthening the magnetic force at the same time.

However, in the braun tube in accordance with the prior art, because the deflection yoke 20 is installed outside of the funnel 10, it is easy to adjust a position of the deflection yoke 20, accordingly the convergence and deflection sensitivity of an electron beam can be easily compensated. However, the deflection performance may lower due to expansion of the magnetic field from the center of the deflection. And, because the deflection yoke 20 is externally exposed, the deflection yoke 20 may be physically affected in the manufacturing process or delivery and has to be reset in that case.

Accordingly, in order to solve problems of the braun tube including the deflection yoke 20 installed outside of the funnel 10, an in-neck deflection yoke type braun tube including the deflection yoke 20 which is installed inside the funnel 10 has been developed.

As depicted in FIG. 2, in an in-neck deflection yoke type braun tube, a deflection yoke 20' is installed inside a funnel 10'.

In other words, a holder 27' attached to an electron gun 14' is installed inside the funnel 10', the holder 27' is constructed so as to support a horizontal deflection coil 21', a vertical deflection coil 23' and a ferrite core 25'.

As described above, when the deflection yoke 20' is installed inside the funnel 10', a neck portion 11' of the funnel 10' is wider than the neck portion 11 of the braun tube of FIG. 1, and the overall outer structure of the braun tube can be simplified.

Particularly, the in-neck deflection yoke type braun tube can have the more improved deflection sensitivity on the comparison with the braun tube of FIG. 1 as the deflection yoke 20 is installed outside of the funnel 10, the reason will now be described.

In general, the deflection sensitivity of an electron beam can be described as power generated by currents and voltages applied to deflection coils performing deflection in the vertical and horizontal directions, it can be described as below.

$$P_H = \frac{1}{2} L_H I_H^2 \tag{1}$$

$$P_V = \frac{1}{2} R_V I_V^2 \tag{2}$$

Herein, $P_H$ and $P_V$ describe the horizontal deflection sensitivity and vertical deflection sensitivity, respectably, $L_H$ and $R_V$ describe the inductance of a horizontal deflection coil and the resistance a vertical deflection coil, respectively, and $I_H$ and $I_V$ describe currents applied to the horizontal deflection coil and vertical deflection coil, respectively.

With reference to the above-described equations 1 and 2, it is better to improve the deflection sensitivity of the braun tube with a small quantity of power, accordingly the more $P_H$ and $P_V$ lower in equations 1 and 2, the more the deflection sensitivity improves.

In a general braun tube, when a frequency of current applied in a horizontal direction is a high frequency not less than 15.75 kHz, an inductance value is a main adjustment factor, on the contrary when a frequency of current applied in a vertical direction is a low frequency as 60 Hz, a resistance value is a main adjustment factor.

Accordingly, in order to improve the deflection sensitivity of the braun tube, a $L_H$ value of the horizontal deflection coil and a $R_V$ value of the vertical deflection coil have to lower on the basis of the same current value.

Accordingly, in the in-neck deflection yoke type braun tube, because the deflection yoke 20' is installed inside the funnel 10', although the same amount of current is applied to the horizontal and vertical deflection coils 21', 23', the deflection force of an electron beam in up-and-down and right-and-left directions can improve by generating a bigger magnetic field inside the funnel 10'.

In the in-neck deflection yoke type braun tube, because the deflection yoke 20' is installed inside the funnel 10', external physical influence can be minimized. However it is difficult to compensate the convergence and deflection sensitivity of an electron beam after the deflection yoke 20' is installed.

In addition, in the in-neck deflection yoke type braun tube, gas elements included in the ferrite core 25' of the deflection yoke 20' can leak inside the funnel 10' due to a high temperature circumstances in the fabrication process of the braun tube or operation of the braun tube, it may damage a characteristic of the braun tube which can show the sufficient performance in a vacuum state, accordingly lots of work are required in order to prevent it.

SUMMARY OF THE INVENTION

In order to solve above-mentioned problems, an object of the present invention is to provide a deflection yoke for a braun tube which is capable of compensating the convergence and deflection sensitivity of an electron beam, and increasing the degree of freedom in designing a deflection yoke and an electron gun required for enlarging a diameter of an electron gun by installing a ferrite core outside of a funnel and installing a horizontal deflection coil and a vertical deflection coil inside the funnel.

In order to achieve the object of the present invention, there is provided a deflection yoke for a braun tube in accordance with embodiments of the present invention installed at a neck portion of a funnel and including a horizontal deflection coil, a vertical deflection coil and a ferrite core in order to deflect an electron beam radiated from an electron gun toward a determined position of a screen, the vertical deflection coil is installed inside a funnel, the ferrite core is installed outside of the funnel, and the vertical deflection coil is installed inside or outside of the funnel.

In an embodiment of the present invention, a vertical deflection coil is installed inside a funnel and is fixed by a first holder attached to an electron gun with a horizontal deflection coil. And, a ferrite core is fixed to outside of the funnel by a fixing means and its inner diameter is larger than an outer diameter of the funnel so as to move in up-and-down and right-and-left directions outside of the funnel.

In another embodiment of the present invention, a vertical deflection coil is installed outside of a funnel with a ferrite core.

DETAILED DESCRIPTION OF THE PREFERRED EMBODIMENT

Hereinafter, a deflection yoke for a braun tube in accordance with embodiments of the present invention will now be described with reference to accompanying drawings.

A plurality of embodiments in accordance with the present invention can exist, hereinafter the preferred embodiments will be described.

Figure 3:
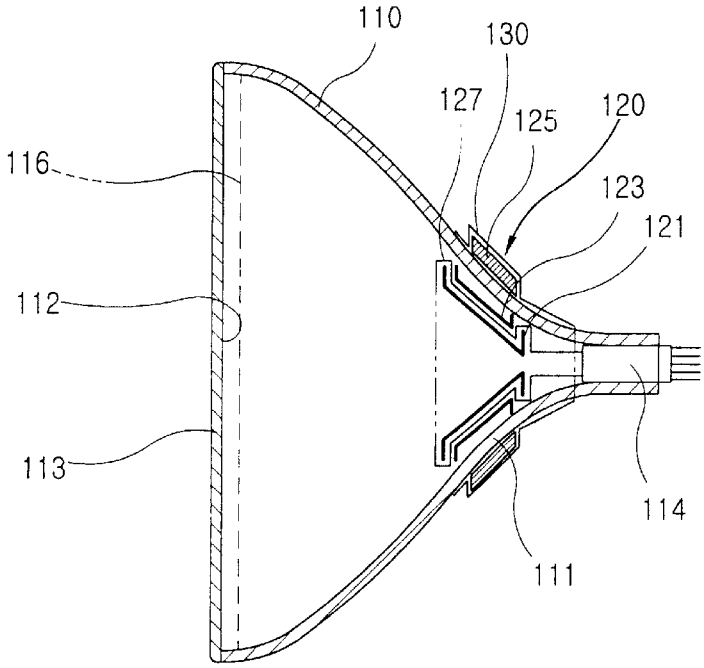
FIG. 3 is a sectional view illustrating a deflection yoke for a braun tube in accordance with an embodiment of the present invention.

FIG. 3 is a sectional view illustrating a deflection yoke for a braun tube in accordance with an embodiment of the present invention.

As depicted in FIG. 3, a braun tube in accordance with an embodiment of the present invention includes a funnel 110, a panel 112 combined to a front side of the funnel 110, an electron gun 114 installed at the rear of the funnel 110 and radiating an electron beam, and a shadow mask 116 installed with a certain distance from the panel 112.

Particularly, a deflection yoke 120 is installed at a neck portion 111 of the funnel 110 in order to deflect an electron beam radiated from the electron gun 114 toward a determined position of a screen 113.

In the embodiment of the present invention, the deflection yoke 120 includes a horizontal deflection yoke 121 deflecting an electron beam in a horizontal direction on the basis of a center of deflection by generating a magnetic field in a vertical direction, a vertical deflection coil 123 deflecting an electron beam in a vertical direction on the basis of the center of deflection by generating a magnetic field in a horizontal direction, and a ferrite core 125 preventing a magnetic field generated by currents applied to the horizontal and vertical deflection coils 121, 123 from leaking out and strengthening a magnetic force at the same time.

Herein, the horizontal and vertical deflection coils 121, 123 are installed inside the neck portion 111 of the funnel 110, and the ferrite core 125 is installed outside side of the funnel 110.

In more detail, the horizontal deflection coil 121 and vertical deflection coil 123 are installed inside the neck portion 111 of the funnel 110 so as to place near to a space an electron beam moves in.

And, the ferrite core 125 is installed outside of the funnel 110 corresponded to the horizontal and vertical deflection coils 121, 123 installed inside the funnel 110 in order to prevent a magnetic field generated by the horizontal and vertical deflection coils 121, 123 from leaking.

In addition, the horizontal deflection coil 121 and vertical deflection coil 123 are fixed to a first holder 127 attached to the electron gun 114, however because an inner diameter of the ferrite core 125 is bigger than an outer diameter of the funnel 110, the ferrite core 125 can move in up-and-down and right-and-left directions outside of the funnel 110.

As described above, in the braun tube in accordance with the embodiment of the present invention, because the inner diameter of the ferrite core 125 can be bigger by installing the horizontal and vertical deflection coils 121, 123 inside the braun tube and installing the ferrite core 125 outside of the braun tube centering around the funnel 110, an inductance lowering factor and a deflection sensitivity lowering factor can be compensated, accordingly the overall inductance sensitivity can improve in comparison with the prior art.

In adjustment of the inner diameter of the ferrite core 125, when the sizes of the horizontal deflection coil 121 and vertical deflection coil 123 are maintained as same, an inductance value will increase and a deflection current will decrease as the inner diameter of the ferrite core 125 decreases. In more detail, an inductance value will decrease and a deflection current value will increase as the inner diameter of the ferrite core 125 increases. Accordingly, it is possible to adjust the deflection sensitivity by varying the inner diameter of the ferrite core 125.

In other words, it is possible to adjust the decline and a position (front/rear) of the ferrite core 125 centering around a center axis of the deflection yoke 120 by forming the inner diameter of the ferrite core 125 so as to be larger than the outer diameter of the funnel 110, herein the heterogeneity of a magnetic field caused by the asymmetry or mis-alignment of the horizontal and vertical deflection coils 121, 123 installed inside the funnel 110 can be compensated by adjusting the decline and position of the ferrite core 125.

Because the distribution and shape of a magnetic field generated according to the position and shape of the horizontal and vertical deflection coils 121, 123 can be changed in accordance with the position and shape of the ferrite core 125, the asymmetry of the magnetic field can decrease by making the center axis of the ferrite core 125 correspond to the center axes of the horizontal deflection coil 121 and vertical deflection coil 123.

Figure 1:
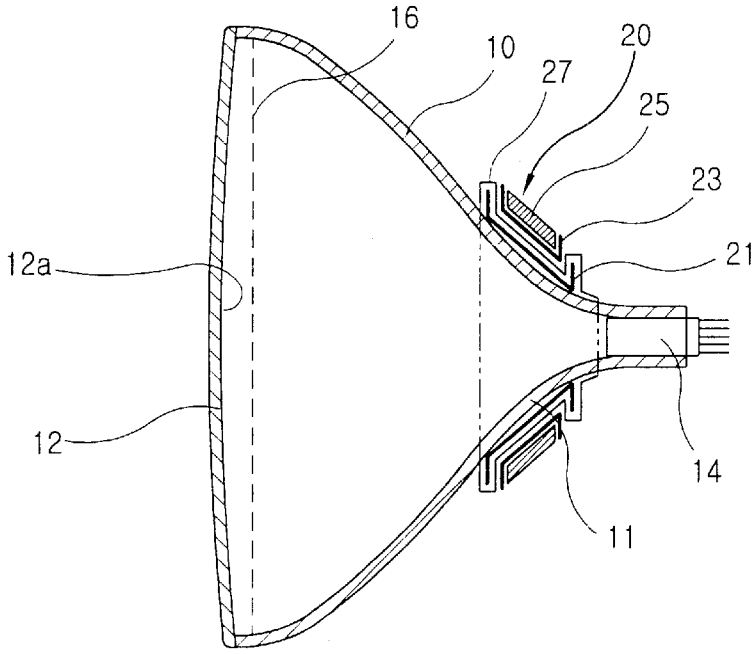
FIG. 1 CONVENTIONAL ART
FIG. 1 is a schematic sectional view illustrating a braun tube including an external installation type deflection yoke in accordance with the conventional art.
Figure 2:
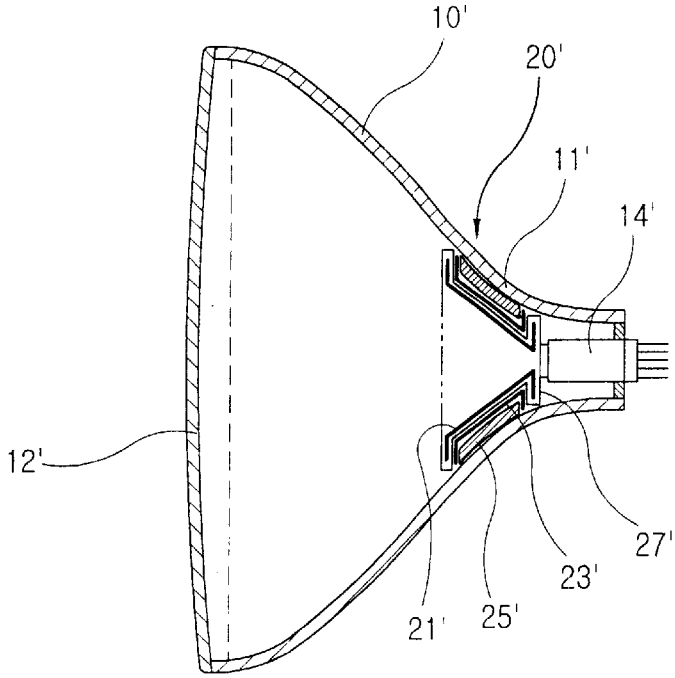
FIG. 2 CONVENTIONAL ART
FIG. 2 is a schematic sectional view illustrating an in-neck deflection yoke type braun tube in accordance with the conventional art.

Accordingly, the present invention can have not only the same deflection sensitivity as the in-neck deflection yoke type braun tube of FIG. 2 by installing the horizontal and vertical deflection coils 121, 123 inside the funnel 110, but also can easily compensate deviation of the axes of the center of the electron gun 114 and deflection yoke 120 by installing the ferrite core 125 outside of the funnel 110.

And, by installing the ferrite core 125 outside of the funnel 110, because the inner space of the funnel 110 increases; the degree of freedom in designing the deflection yoke 120 and electron gun 114 related to enlarging a diameter of the electron gun 114 increases, the productivity of the braun tube increases, and the manufacturing cost of the braun tube decreases.

Figure 4:
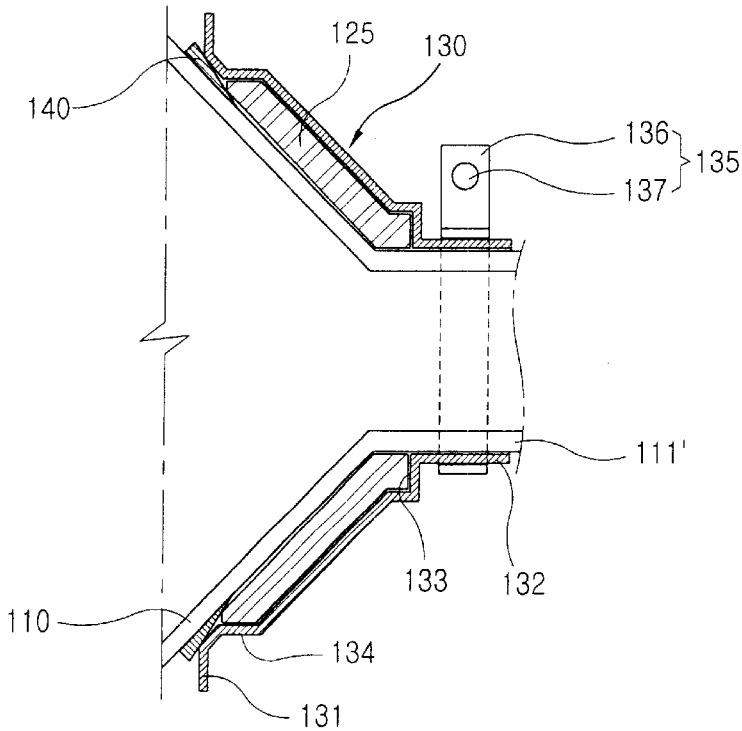
FIG. 4 is a detailed sectional view illustrating a ferrite core support structure in accordance with the embodiment of the present invention.

FIG. 4 is a detailed sectional view illustrating a support structure of the ferrite core in accordance with the embodiment of the present invention.

With reference to FIG. 4, the ferrite core 125 is fixed to the funnel 110 by a funnel-shaped second holder 130 whose both ends are open.

Because the second holder 130 has to fix the ferrite core 125, movement resistance portions 133, 134 are formed on the both ends of the second holder 130 in order to prevent the ferrite core 125 from moving.

In more detail, in order to minimize leakage of a magnetic field by placing the inner diameter of the ferrite core 125 near to the funnel 110 to the highest degree, the second holder 130 surrounds the outer circumference of the ferrite core 125.

An inner diameter of a front end (a screen side) of the second holder 130 is formed so as to be larger than an inner diameter of a front end (a screen side) of the ferrite core 125 in order to adjust the decline of the ferrite core 125 with a wedge 140.

In more detail, when the ferrite core 125 is fixed to the funnel 110 by the second holder 130, the wedge 140 is inserted between the ferrite core 125 and funnel 110 from the screen side in order to adjust the decline of the ferrite core 125 in up-and-down and right-and-left directions, accordingly the wedge 140 can easily compensate a characteristic due to positional errors of the horizontal and vertical deflection coils 121, 123 inside the funnel 110.

And, a rear end 132 (an electron gun side) of the second holder 130 is fixed to a band type clamp 135 attached to a circumference of the neck portion 111 of the funnel 110.

The band type clamp 135 is constructed with a ring-shaped band 136 and a fastening member 137 fastening the both ends of the ring-shaped band 136.

In the meantime, the second holder 130 can compensate the misconvergence of a screen by connecting a multipolar element such as a tetrode, a hexode, an octode, etc. in order to apply an adjustment current synchronized with the horizontal and vertical deflection currents.

In addition, the second holder 130 can have a protrusion portion for placing a circuit substrate included in the deflection yoke 120.

As described above, the second holder 130 not only fixes the ferrite core 125 outside of the funnel 110 but also helps to adjust a position of the ferrite core 125 when the deflection yoke 120 is compensated.

In the meantime, in the embodiment of the present invention, the ferrite core 125 is fixed to the funnel 110 by the second holder 130. However, the ferrite core 125 can be fixed to outside of the funnel 110 not using the second holder 130 but using a bonding agent.

Figure 5:
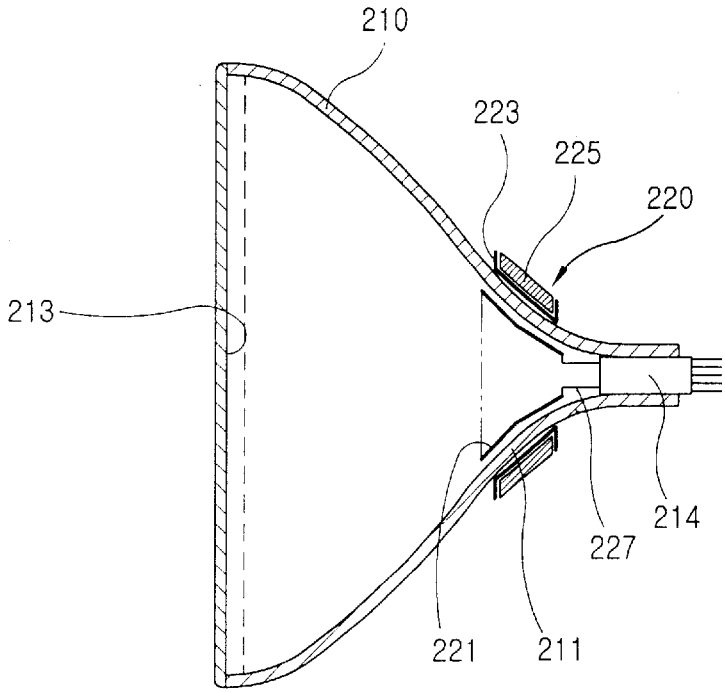
FIG. 5 is a sectional view illustrating a deflection yoke for a braun tube in accordance with another embodiment of the present invention.

FIG. 5 is a sectional view illustrating a deflection yoke for a braun tube in accordance with another embodiment of the present invention.

On the contrary with the embodiment of the present invention installing the vertical deflection coil 121 inside the funnel 110, in the another embodiment of the present invention the vertical deflection coil 221 is installed outside of the funnel 210.

In more detail, in the another embodiment of the present invention, only the horizontal deflection coil 221 is installed inside the funnel 210, the vertical deflection coil 223 and ferrite core 225 are installed outside of the funnel 210.

Herein, a position of the horizontal deflection coil 221 is fixed by being supported by a holder 227 attached to the electron gun 214.

And, the vertical deflection coil 223 is formed as a saddle shape its both ends are curved toward the outside and its un-curved portion is placed inside the ferrite core 225.

In the meantime, the horizontal deflection coil 221 and vertical deflection coil 223 can be directly adhered to the interior and exterior of the funnel 210 by using a bonding agent without using any additional device.

In FIG. 5, a unexplained reference numeral 213 is a screen, and a unexplained reference numeral 211 is a neck portion of a funnel.

Figure 6:
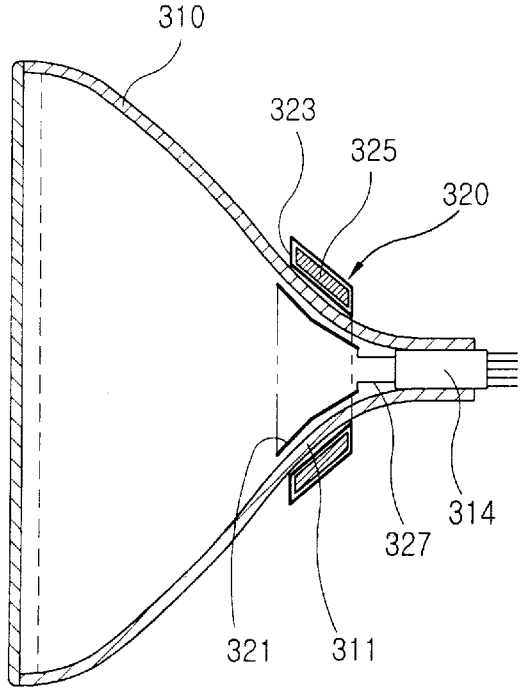
FIG. 6 is a sectional view illustrating a deflection yoke for a braun tube in accordance with yet another embodiment of the present invention.

FIG. 6 is a sectional view illustrating a deflection yoke for a braun tube in accordance with yet another embodiment of the present invention.

In the yet another embodiment of the present invention, a vertical deflection coil 323 winds around a ferrite core 325 as a toroidal shape.

In a deflection yoke 320 in accordance with the yet another embodiment of the present invention, a horizontal deflection coil 321 is installed inside a funnel 320 as the another embodiment of the present invention, and the ferrite core 325 winded by the vertical deflection coil 323 is installed outside of the funnel 310.

A unexplained reference numeral 311 is a neck portion of a funnel, 314 is an electron gun, and 327 is a holder supporting the horizontal deflection coil 321.

In the above-described another and yet another embodiments of the present invention, by installing the horizontal deflection coil 221, 321 inside the funnel 210, 310, the load inside the funnel 210, 310 can decrease and a larger deflection angle can be formed in a horizontal direction, accordingly consumption of the current and the total length of the braun tube can decrease by increasing the deflection angle.

In addition, by installing the vertical deflection coil 223, 323 and ferrite core 225, 325 outside of the funnel 210, 310, the degree of freedom in designing a deflection yoke and an electron gun related to enlarging a diameter of the electron gun increases as the above-described one embodiment.

What is claimed is:

1. A deflection yoke for a braun tube installed at a neck portion of a funnel of the tube comprising:

a horizontal deflection coil;

a vertical deflection coil; and a ferrite core, the deflection yoke being configured to deflect an electron beam radiated from an electron gun onto a predetermined position on a screen, wherein the horizontal coil is installed inside the funnel, the ferrite core is installed outside of the funnel, and the vertical deflection coil is installed one of inside and outside of the funnel.

2. The deflection yoke according to claim 1, wherein the vertical deflection coil is installed inside the funnel.

3. The deflection yoke according to claim 2, wherein the horizontal deflection coil and vertical deflection coil are separately installed on a first holder attached to an electron gun.

4. The deflection yoke according to claim 2, wherein the ferrite core is fixed to outside of the funnel by a fixing means and an inner diameter of the ferrite core is larger than an outer diameter of the funnel so as to move in up-and-down and right-and-left directions outside of the funnel.

5. The deflection yoke according to claim 4, wherein the fixing means is a plurality of wedges inserted between the ferrite core and funnel.

6. The deflection yoke according to claim 4, wherein the fixing means is a funnel-shaped second holder whose both ends are open and which is fixed to outside of the funnel.

7. The deflection yoke according to claim 6, wherein the second holder fixes the ferrite core by being placed outside of the ferrite core.

8. The deflection yoke according to claim 7, wherein the second holder includes a plurality of movement resistance portions provided at both ends of the second holder in order to prevent the ferrite core from moving.

9. The deflection yoke according to claim 6, wherein the second holder is fixed to the funnel by a band type clamping means attached to a circumference of a neck portion of the funnel.

10. The deflection yoke according to claim 1, wherein the vertical deflection coil is installed outside of the funnel.

11. The deflection yoke according to claim 10, wherein the horizontal deflection coil is installed on a holder fixed to an electron gun.

12. The deflection yoke according to claim 10, wherein the vertical deflection coil is formed as a saddle shape and is fixed inside the ferrite core.

13. The deflection yoke according to claim 10, wherein the vertical deflection coil winds around the ferrite core as a toroidal shape.

* * * * *